US006825431B2

(12) United States Patent
Azzola et al.

(10) Patent No.: US 6,825,431 B2
(45) Date of Patent: Nov. 30, 2004

(54) ARC CHAMBER FOR LOW-VOLTAGE CIRCUIT BREAKERS

(75) Inventors: Lucio Azzola, Bergamo (IT); Michele Ferrari, Bergamo (IT)

(73) Assignee: ABB Service S.r.l., Milan (IT)

( * ) Notice: Subject to any disclaimer, the term of this patent is extended or adjusted under 35 U.S.C. 154(b) by 0 days.

(21) Appl. No.: 10/169,406

(22) PCT Filed: Dec. 20, 2000

(86) PCT No.: PCT/EP00/13344

§ 371 (c)(1),
(2), (4) Date: Jul. 1, 2002

(87) PCT Pub. No.: WO01/50488

PCT Pub. Date: Jul. 12, 2001

(65) Prior Publication Data

US 2003/0000925 A1 Jan. 2, 2003

(30) Foreign Application Priority Data

Dec. 31, 1999 (IT) ..... MI99A2762

(51) Int. Cl.[7] ..... H01H 33/02
(52) U.S. Cl. ..... 218/156; 218/149
(58) Field of Search ..... 218/14–15, 24, 218/27, 34, 149–158; 335/201–202

(56) References Cited

U.S. PATENT DOCUMENTS

| | | | | |
|---|---|---|---|---|
| 3,440,378 A | * | 4/1969 | Baird | 218/34 |
| 5,475,193 A | * | 12/1995 | Perdoncin | 218/34 |
| 5,539,170 A | | 7/1996 | Palmer et al. | |
| 5,589,672 A | * | 12/1996 | Uchida et al. | 218/34 |

FOREIGN PATENT DOCUMENTS

| | | |
|---|---|---|
| CH | 665052 | 4/1988 |
| DE | 1005592 | 4/1957 |
| FR | 2363181 | 3/1978 |

* cited by examiner

*Primary Examiner*—Lincoln Donovan
(74) *Attorney, Agent, or Firm*—Connolly Bove Lodge & Hutz LLP; Larry J. Hume

(57) ABSTRACT

An arc chamber for low-voltage circuit breakers, whose particularity consists of the fact that it comprises: multiple substantially U-shaped metallic plates; an enclosure made of insulating material which is substantially shaped like a parallelepiped and comprises two side walls, a bottom wall, a top wall and a rear wall, the side walls having, on the inside, multiple mutually opposite slots for the insertion of the metal plates, the bottom and top walls each having at least one opening and the enclosure being open at the front.

21 Claims, 4 Drawing Sheets

ARC CHAMBER FOR LOW-VOLTAGE CIRCUIT BREAKERS

CROSS-REFERENCE TO RELATED APPLICATIONS

This application is a U.S. National Stage entry under 35 U.S.C. § 371 of co-pending International Patent Application No. PCT/EP00/13344, filed on Dec. 20, 2000 by Azzola, Lucio et al., and for which priority is claimed under 35 U.S.C. § 119 to Italian application MI99A002762 filed on Dec. 31, 1999.

The present invention relates to an arc chamber for low-voltage circuit breakers, particularly for molded case power circuit breakers.

It is known that molded case power circuit breakers are normally used in industrial low-voltage electrical systems, i.e., systems operating at up to approximately 1000 Volt. Said circuit breakers are usually provided with a system which ensures the nominal current required for the various users, the connection and disconnection of the load, protection against any abnormal conditions, such as overloading and short-circuit, by automatically opening the circuit, and the disconnection of the protected circuit by opening the moving contacts with respect to the fixed contacts (galvanic separation) in order to achieve full isolation of the load with respect to the electric power source.

The critical function of interrupting the current (whether nominal, overload or short-circuit current) is provided by the circuit breaker in a specific portion of said circuit breaker which is constituted by the so-called deionizing arc chamber. As a consequence of the opening movement, the voltage between the contacts causes the dielectric discharge of the air, leading to the forming of the electric arc in the chamber. The arc is propelled by electromagnetic and fluid-dynamics effects inside a series of metal plates arranged in the chamber, which are meant to extinguish said arc by cooling.

During arc forming, the energy released by Joule effect is very high and causes thermal and mechanical stresses inside the plate containment region. In order to withstand these stresses, the design of the arc chamber must be evaluated carefully so as to obtain a component which is solid enough to withstand the mechanical stresses and clearly defined so as to appropriately guide the arc into the extinguishing region while providing protection of the regions that must not be affected. Also, it is a common practice to include in the arc chamber elements made of insulating materials capable of emitting gaseous substances in the presence of an electric arc. Such substances interact with the plasma ions generated by the arc, thereby contributing to the reduction of overall phenomenon by reducing the conductivity.

FIGS. 1 and 2 illustrate a typical example of an arc chamber of the prior art. The chamber generally comprises two side walls 1 made of insulating material, a plurality of metallic plates 2 and at least one protective element 3 made of insulating material. The plates 2 are generally U-shaped and have, at their outer lateral edges, a plurality of protrusions 21. The side walls 11 have a plurality of openings 11 which are suitable to mate with the corresponding protrusions 21 of the plates 2 (see FIG. 2) for plate positioning and fixing. Plate fixing is provided, for example, by upsetting the protrusions 21, thus ensuring containment of the plates and mechanical stability of the arc chamber. Once assembled, the arc chamber is inserted in an appropriately provided space formed in the case of the circuit breaker.

Although this solution adequately meets the necessary requirements, it is not entirely satisfactory in terms of the number of components required and of manufacturing complexity. In addition to the side walls made of insulating material, it is in fact also necessary to provide appropriate components (for example the protective element 3) for arc guiding/protection.

Furthermore, the fact must not be ignored that adequate mechanical stability is ensured only by virtue of the complicated operation of fixing the plates to the side walls, for example by upsetting the protrusions that are present on the edges of the plates.

The aim of the present invention is to provide an arc chamber for low-voltage circuit breakers, which is constituted by a limited number of components which is smaller than the number of components of conventional arc chambers.

Within the scope of this aim, an object of the present invention is to provide an arc chamber for low-voltage circuit breakers, which does not require complicated assembly steps.

Another object of the present invention is to provide an arc chamber for low-voltage circuit breakers, which has adequate mechanical stability without requiring complicated mechanical processes.

Another object of the present invention is to provide an arc chamber for low-voltage circuit breakers, which can be easily assembled inside the pole of the circuit breaker.

A further object of the present invention is to provide an arc chamber for low-voltage circuit breakers, which does not require the use of additional elements capable of emitting gaseous substances which reduce the arc-related phenomena. Another object of the present invention is to provide an arc chamber for low-voltage circuit breakers which is highly reliable, relatively easy to manufacture and at competitive costs.

This aim, these objects and others which will become apparent hereinafter are achieved by an arc chamber for low-voltage circuit breakers, characterized in that it comprises:

multiple substantially U-shaped metallic plates;

an enclosure made of insulating material which is substantially shaped like a parallelepiped and comprises two side walls, a bottom wall, a top wall and a rear wall, said side walls having, on the inside, multiple mutually opposite slots for the insertion of said metal plates, the bottom and top walls each having an opening, said enclosure being open at the front.

In this manner, one has the advantage of providing a mechanically stable arc chamber with a reduced number of components and of avoiding the complex mechanical operation of upsetting.

Further characteristics and advantages of the arc chamber according to the invention will become apparent from the description of a preferred but not exclusive embodiment, illustrated only by way of non-limitative example in the accompanying drawings, wherein.

Figure 1:
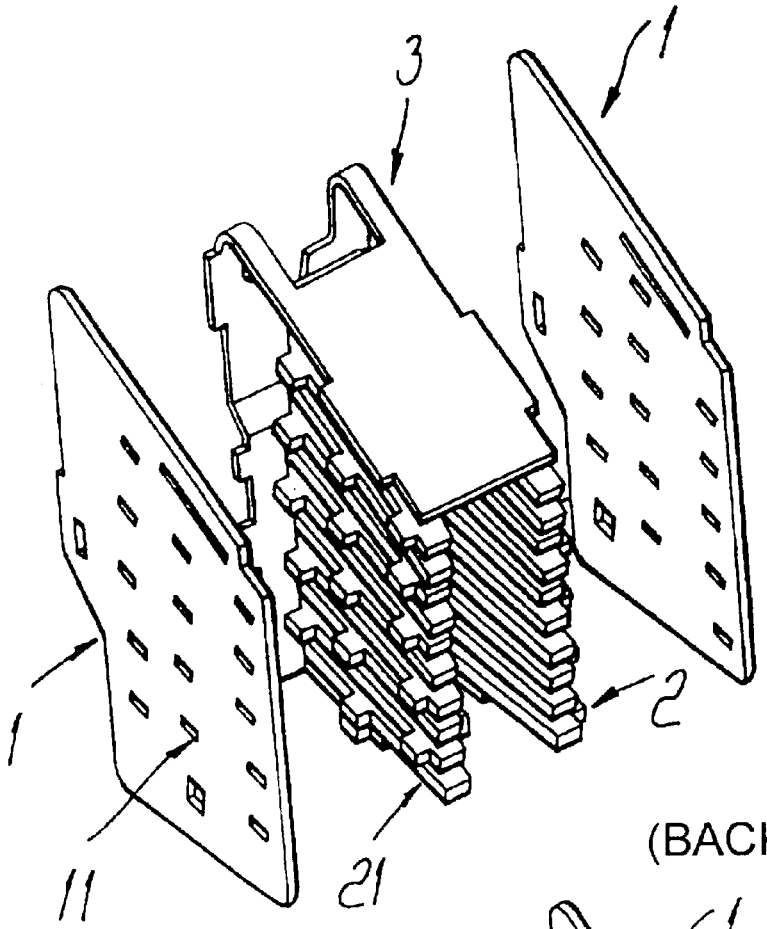
Fig. 1 (BACKGROUND ART)
FIG. 1 is an exploded perspective view of a disassembled arc chamber of the prior art.
Figure 2:
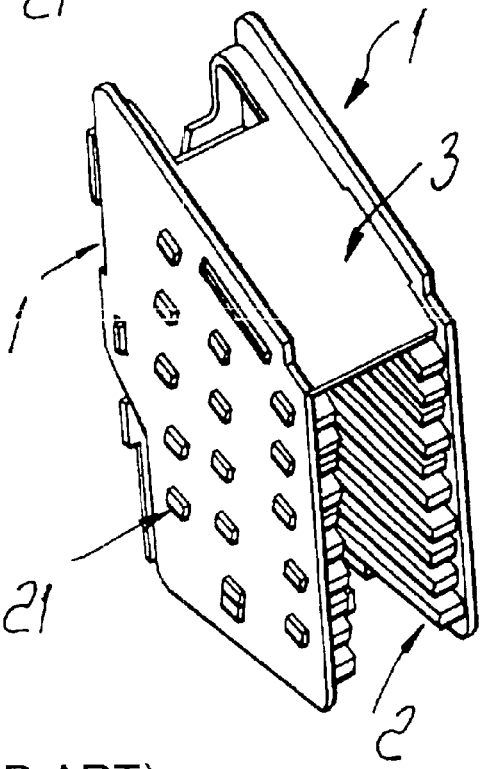
Fig. 2 (BACKGROUND ART)
FIG. 2 is a perspective view of an assembled arc chamber of the prior art.
Figure 3:
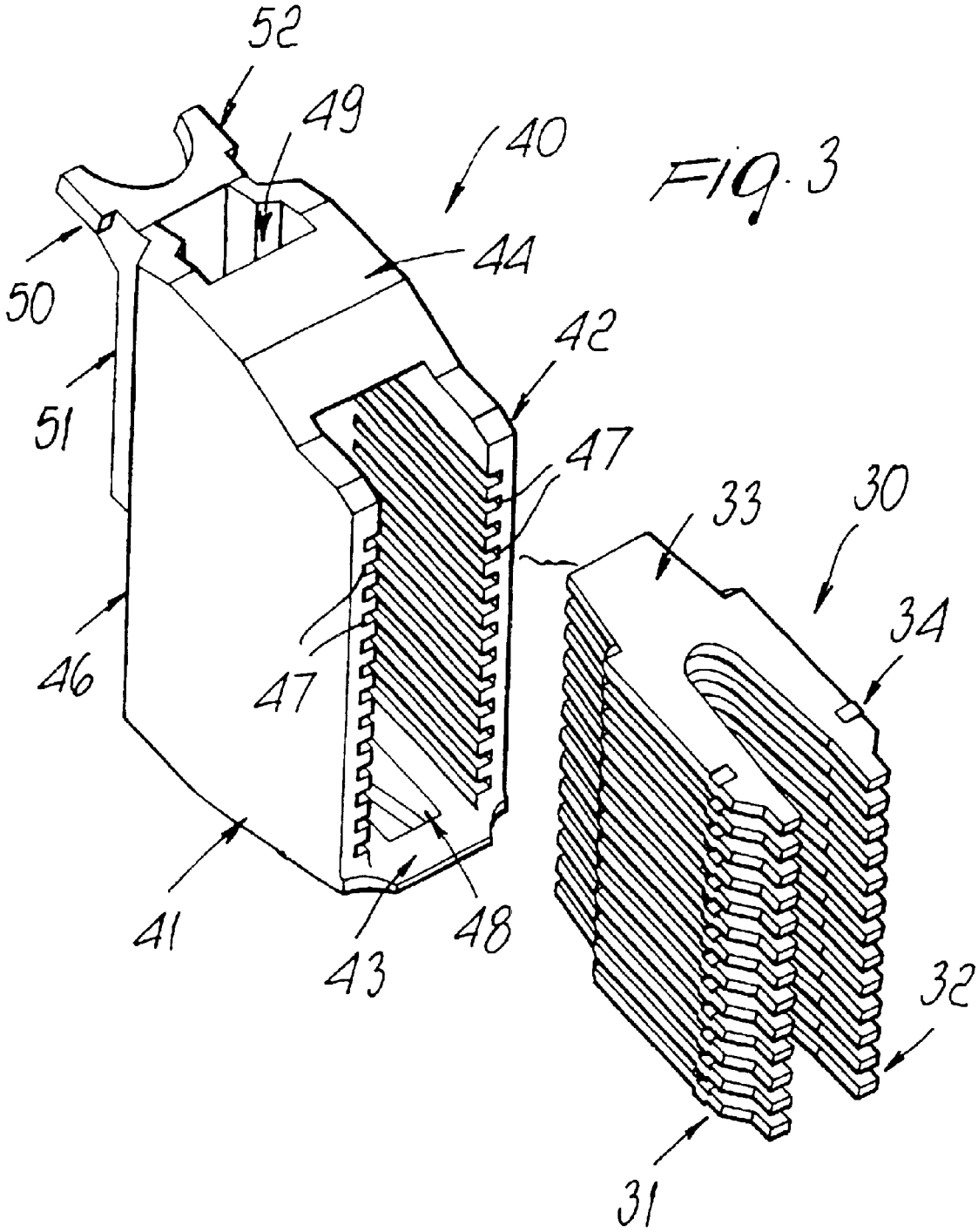
FIG. 3 is an exploded perspective view of a disassembled arc chamber according to the invention.

With reference to FIG. 3, the arc chamber according to the invention, which is shown disassembled for the sake of clarity, comprises a plurality of metal plates 30 which are substantially U-shaped. The arc chamber furthermore comprises an enclosure 40 made of insulating material which is substantially shaped like a parallelepiped, with two side walls 41 and 42, a bottom wall 43, a top wall 44, and a rear wall 46. The enclosure 40 is open at the front wall so as to allow the insertion of the plates 30, as described in detail hereinafter. The side walls are internally provided with a plurality of mutually opposite slots 47 for the sliding insertion of the metal plates 30. The bottom wall has at least one opening 48 to allow the passage of the arc quenching contact. Conveniently, the top wall has at least one opening 49 which allows the venting of the gases that are generated. The lower wall 43, the top wall 44 and the rear wall 46 also protect the regions that must not be affected by the arc.

The assembly of the arc chamber thus conceived is therefore greatly facilitated, the only necessary operation being the insertion of the plates 30 in the slots 47 of the enclosure 40.

Advantageously, according to a preferred embodiment of the arc chamber according to the invention, the slots 47 cover only a portion of the internal surface of the side walls 41 and 42 rather than its entire length. Correspondingly, the metal plates 30 have two lateral arms 31 and 32, which form the arms of the U-shape, and a solid bottom portion 33, which is approximately as wide as the distance between the side walls 41 and 42 or, more generally, is shaped so as to correspond to the internal profile of the side walls 41 and 42. The width of the plates 30 at the lateral arms 31 and 32 is approximately equal to the distance between the end surfaces of two mutually opposite slots 47.

Advantageously, the metal plates 30 have at least one raised portion 34 at at least one of the lateral arms 31 and 32, preferably at both arms 31 and 32. When the plate 30 is inserted in a pair of mutually opposite slots 47, said raised portion mechanically contrasts with the internal surfaces of the slot, ensuring that the position is maintained during assembly.

Preferably, the length of the lateral arms 31 and 32 is greater than the length of the slots 47, so that the lateral arms at least partly protrude frontally from the body of the enclosure made of insulating material.

According to a preferred embodiment, the rear wall 46 of the arc chamber according to the invention has a shaped protrusion 50. Conveniently, the protrusion 50 has a portion 51 which runs along at least one portion of the rear wall 50 and a shaped raised portion 52 at the upper end of the rear wall.

The protrusion 50 and the dimensions of the arms 31 and 32 facilitate the assembly of the arc chamber inside the pole and contribute to the containment of the plates 30.

The arc chamber according to the invention is in fact conveniently applied in a pole of a low-voltage circuit breaker and is particularly suitable for low-voltage molded case power circuit breakers.

Figure 4:
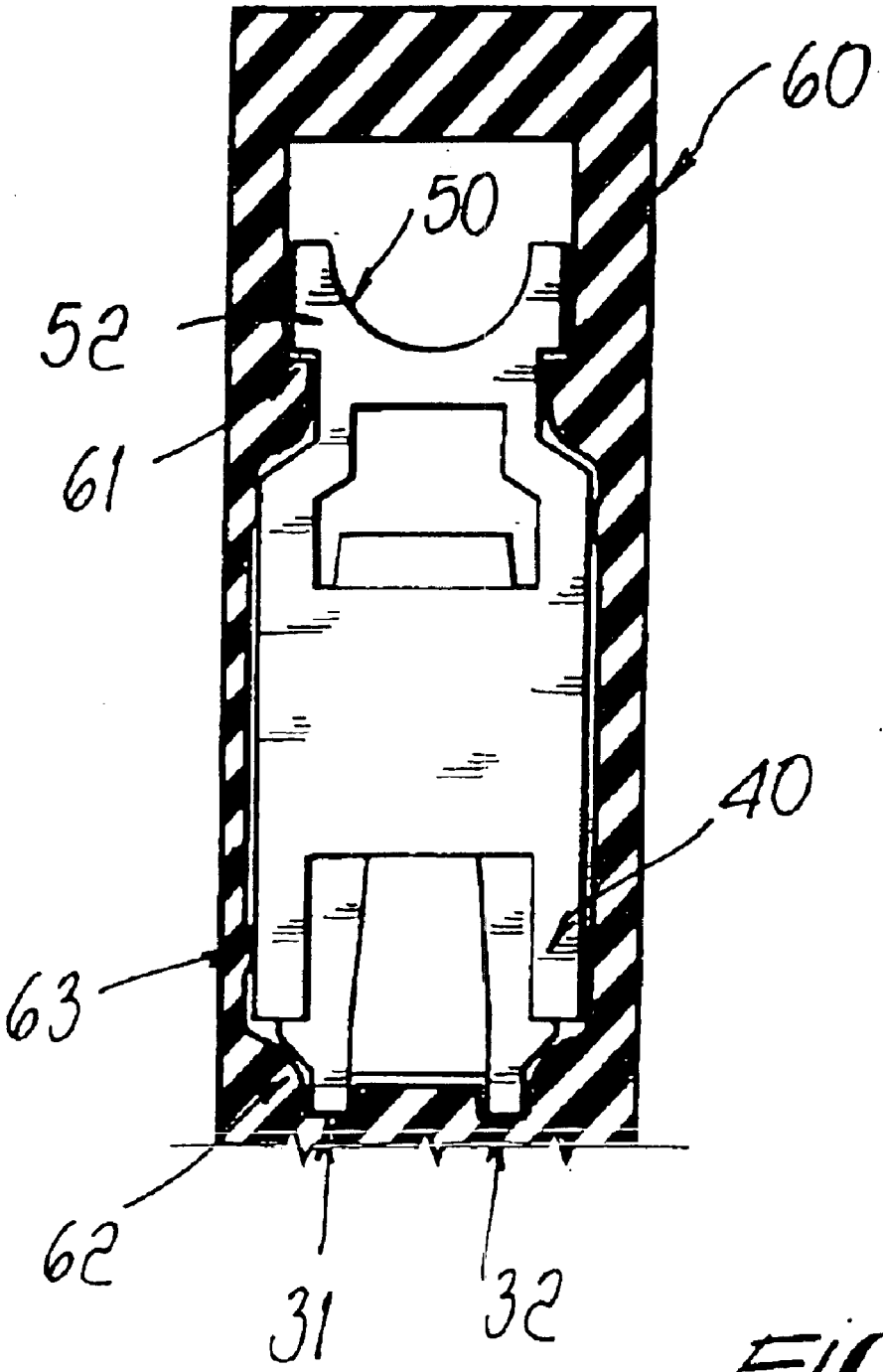
FIG. 4 is a plan view of a pole of a low-voltage circuit breaker which comprises an arc chamber according to the invention.

FIG. 4 is a plan view of a pole of a low-voltage circuit breaker which comprises an arc chamber according to the invention. According to a general embodiment, the pole comprises a case 60 made of insulating material, inside which there is an arc chamber according to the invention. In the case of low-voltage molded case power circuit breakers, the case 60 is constituted by the molded plastic case of said circuit breaker.

According to the embodiment of FIG. 4, in which a single pole is shown for the sake of simplicity, the case 60 has, on its internal surface, a shaped profile 61 which is suitable to mate with the protrusion 50 and the shaped raised portion 52 of the arc chamber.

Preferably, the case 60 has an additional internal shaped profile 62 which is suitable to mate complementarily with the front end of the arms 31 and 32 of the plates 30, which protrude from the body of the enclosure 40.

Additional internal protrusions 63, suitable to facilitate the containment of the enclosure 40, can furthermore be present.

In this manner, the case 60 of the pole, which is structurally suitable to withstand intense mechanical stresses, contributes to the mechanical containment of the metal plates.

Figure 5:
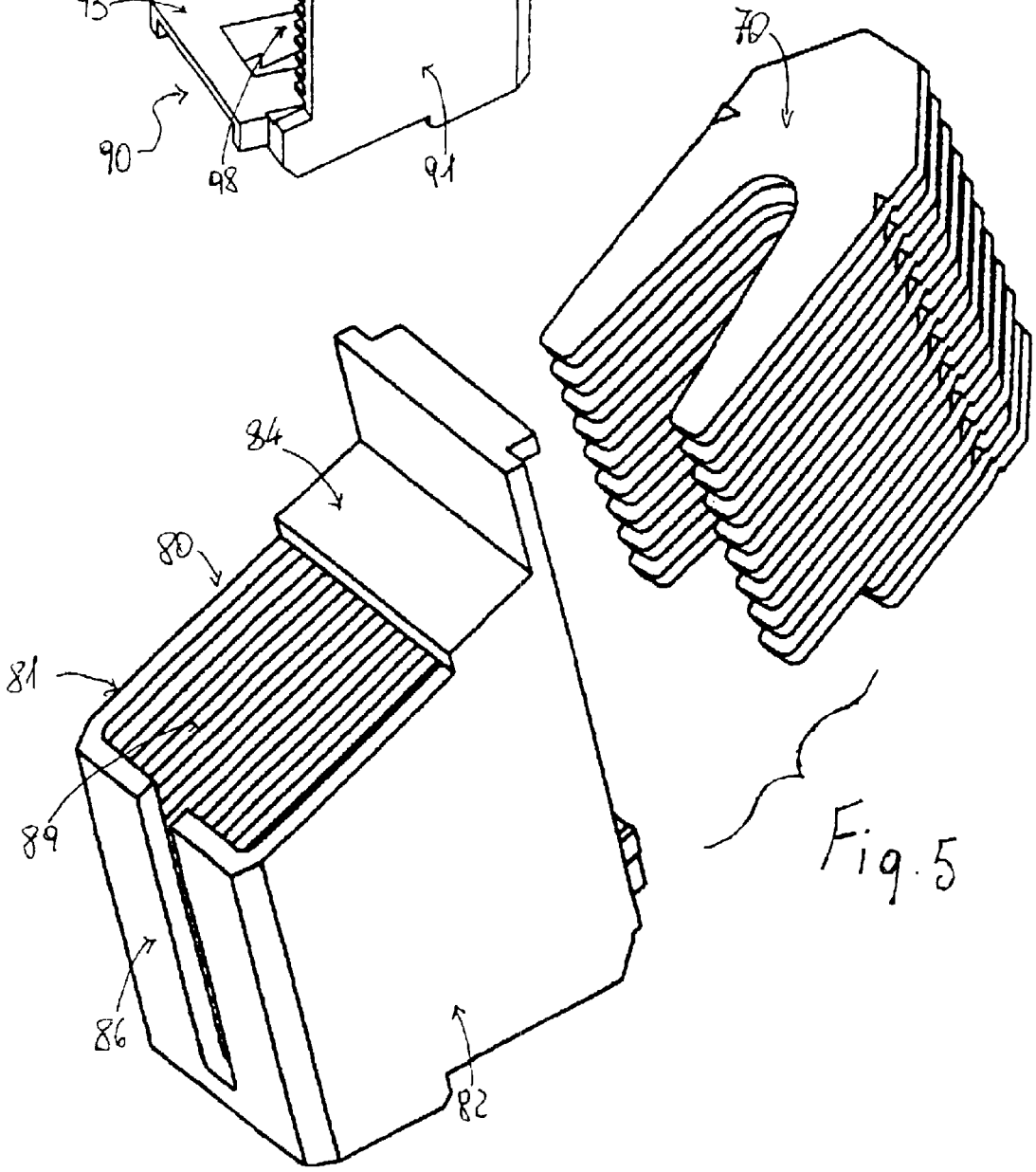
FIG. 5 is an exploded perspective view of an arc chamber according to a further embodiment of the invention.

In the embodiment of FIG. 5, the arc chamber assembly includes a number of substantially U-shaped metal plates. The enclosure 80 is substantially shaped like a parallelepiped and has two side walls 81 and 82, a bottom wall (not shown), a top wall 84 and a rear wall 86. As shown in the figure, the top wall 84 has an opening 89 which allows the venting of the gases. The side walls 81 and 82 are internally provided with a plurality of mutually opposite slots for the sliding insertion of the metal plates 70. In the embodiment of FIG. 5, the slots cover the whole portion of the internal surfaces of the side walls 81 and 82 and the mounting is such that the arms of the U-shaped metal plates are directed inwardly.

Figure 6:
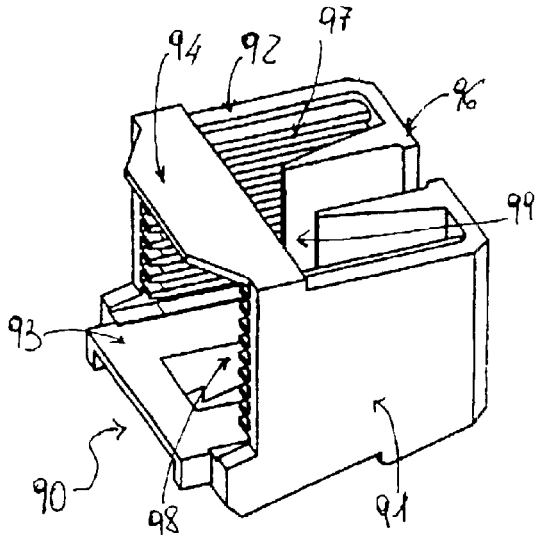
FIG. 6 is a perspective view of an enclosure of an arc chamber according to a further embodiment of the invention.

FIG. 6 represents a further embodiment of an enclosure 90 of an arc chamber according to the invention. Also in this case, the enclosure has two side walls 91 and 92, a bottom wall 93, a top wall 94 and a rear wall 96. The side walls are internally provided, along the whole surfaces, with a plurality of mutually opposite slots 97 for the insertion of the metal plates (not shown). Openings 98 and 99 are present in the bottom and top walls, respectively.

According to a further embodiment of the invention, the enclosure can be made of an insulating material, which includes compounds capable of emitting gaseous substances in the presence of an electric arc, said substances being capable to interact with the plasma ions, thereby reducing the arcing phenomena and related consequences. Examples of such substances are cellulose, melamine, acetalic resins, allumina trihydrate (ATH), fluorinated resins and/or compounds, metal hydrates, unsaturated polyester, etc.

In this way it is possible to avoid using the additional elements normally used in the art. Also, since the overall surface capable of emitting such gases is greater than in the arc chambers of the known types (basically the whole surface of the enclosure is capable of emitting such gases), the performances are by far better than in the prior art.

In practice it has been found that the arc chamber according to the invention fully achieves the intended aim and objects, since it is constituted by a reduced number of components which can be assembled simply, avoiding complicated mechanical upsetting operations. In the proposed embodiment, the only components are the metal plates and the insulating enclosure, which can be assembled automatically.

Mechanical stability is not compromised. As shown, when the arc chamber is inserted in the pole of a circuit breaker, the walls of said pole can contribute to the mechanical containment of the plates.

The use of compounds capable of emitting gaseous substances reduces the extent of the arcing phenomena, and consequently reduces also the mechanical stresses.

The arc chamber thus conceived is susceptible of numerous modifications and variations, all of which are within the scope of the inventive concept; all the details may furthermore be replaced with other technically equivalent elements. In practice, the materials used, so long as they are compatible with the specific use, as well as the dimensions, may be any according to the requirements and the state of the art.

What is claimed is:

1. An arc chamber for low-voltage circuit breakers, comprising:

multiple substantially U-shaped metallic plates;

an enclosure made of insulating material which has a substantially parallelepiped shape and which comprises two side walls, a bottom wall, a top wall and a rear wall, each of said side walls having, on an inside surface thereof, multiple mutually opposite slots into which said metal plates are inserted, the bottom and top walls each having at least one opening, said enclosure being open at the front.

2. The arc chamber according to claim 1, wherein said slots run along at least a portion of the internal surface of the side walls, the metal plates having two lateral arms which determine said U-shaped contour and a solid bottom portion which is substantially as wide as the distance between the internal surfaces of said side walls, the width of said metal plates at said lateral arms being substantially equal to the distance between the end surfaces of two respectively mutually opposite slots.

3. The arc chamber according to claim 1, wherein the metal plates have at least one raised portion on at least one of the lateral arms.

4. The arc chamber according to claim 1, wherein said lateral arms are longer than the slots.

5. The arc chamber according to claim 1, wherein said rear wall has a contoured protrusion.

6. The arc chamber according to claim 5, wherein said protrusion runs along at least one portion of the rear wall of said enclosure and has a contoured raised portion at the upper end of said rear wall.

7. The arc chamber according to claim 1, wherein the slots extend along an entire extent of the internal surfaces of each of the side walls.

8. The arc chamber according to claim 1, wherein said slots extend along only a portion of the internal surfaces of each of the side walls.

9. The arc chamber according to claim 1, wherein the enclosure is made of an insulating material which includes compounds capable of emitting gaseous substances that in the presence of an electric arc can interact with the plasma ions.

10. A pole of a low-voltage circuit breaker, comprising a case made of insulating material and the arc chamber according to claim 1.

11. The pole of a circuit breaker according to claim 10, wherein the case has, on an internal surface thereof, a shape which is complementary to a contoured protrusion provided in the rear wall of the arc chamber.

12. The pole of a circuit breaker according to claim 10, wherein the case has, on an internal surface thereof, a shape which is complementary to a front end of lateral arms of said metal plates.

13. A low-voltage molded case circuit breaker, comprising an arc chamber according to claim 1.

14. The arc chamber according to claim 2, wherein the metal plates have at least one raised portion on at least one of the lateral arms.

15. The arc chamber according to claim 2, wherein the lateral arms are longer than the slots.

16. The arc chamber according to claim 3, wherein the lateral arms are longer than the slots.

17. The arc chamber according to claim 2, wherein the rear wall has a contoured protrusion.

18. The arc chamber according to claim 3, wherein the rear wall has a contoured protrusion.

19. The arc chamber according to claim 4, wherein the rear wall has a contoured protrusion.

20. The arc chamber according to claim 2, wherein the slots extend along the entire internal surfaces of the side walls.

21. The arc chamber of claim 1, wherein the bottom wall, top wall, and rear wall are adapted and arranged to protect external components located outside the arc chamber from the effects of an arc.

* * * * *